US005615667A

United States Patent [19]

Seeley et al.

[11] Patent Number: 5,615,667

[45] Date of Patent: Apr. 1, 1997

[54] SPLATTER OR GREASE GUARD

[76] Inventors: Patricia M. Seeley; Roger L. Seeley, both of HCR, Box 92A, Warba, Minn. 55793

[21] Appl. No.: 644,952

[22] Filed: May 13, 1996

[51] Int. Cl.[6] ..... F24C 3/12

[52] U.S. Cl. ..... 126/42; 126/211; 126/214 D

[58] Field of Search ..... 126/42, 211, 214 D, 126/299 C, 39 N

[56] References Cited

U.S. PATENT DOCUMENTS

| | | | |
|---|---|---|---|
| 2,094,441 | 9/1937 | Aidala | 126/42 |
| 2,764,968 | 10/1956 | Shuster | 126/42 |
| 3,527,200 | 9/1970 | Baltz | 126/42 |
| 3,556,624 | 1/1971 | Baltz et al. | 126/42 X |
| 4,517,705 | 6/1979 | Caan | 126/211 |
| 4,836,181 | 6/1989 | Saga | 126/42 |
| 4,922,888 | 5/1990 | Bryan et al. | 126/42 |
| 5,357,942 | 10/1994 | Williams et al. | 126/211 |

*Primary Examiner*—Larry Jones

*Attorney, Agent, or Firm*—Patent & Trademark Services; Joseph H. McGlynn

[57] ABSTRACT

A substantially U-shaped guard that is attached to pivots that are mounted on the side of the stove. The pivots allow the guard to be moved quickly into or out of position and are detachably secured to the guard so the guard can be removed for cleaning.

5 Claims, 1 Drawing Sheet

SPLATTER OR GREASE GUARD

BACKGROUND OF THE INVENTION

This invention relates, in general, to protective covers, and, in particular, to protective covers for appliances such as stoves or ranges.

Description of the Prior Art

In the prior art various types of guards for stoves have been proposed. For example, U.S. Pat. No. 4,157,705 discloses a guard which is stored in slots on top of the stove and can be removed and placed at the front edge of the stove to prevent children from touching hot burners. U.S. Pat. No. 4,836,181 discloses a safety device for a stove consisting of a guard that is slidable in tracks mounted to the sides of the stove, and which has a portion that folds down to cover the stove controls. U.S. Pat. No. 4,922,888 discloses a protective cover with a magnet that holds the cover in a position to cover the control knobs on the stove. U.S. Pat. No. 5,357,942 discloses a shield for a stove which is attached to the top of the stove and folds down to cover the control knobs.

Although the basic concept of a cover for various portions of a stove is known in the prior art, the previous covers either do not cover and protect the control knobs, or are cumbersome to mount on the stove and to use once they are mounted. For example, the U.S. Pat. No. 4,157,705 device mounts at the front edge of the stove and is not positioned between the burners and the control knobs. Therefore, it can not protect the control knobs from grease splatters. The devices disclosed by the U.S. Pat. Nos. 4,836,181, 4,922,888, and U.S. Pat. No. 5,357,942 patents are difficult to mount, cumbersome to use and difficult to remove and clean once they are mounted.

The present invention is directed to a splatter or grease guard that will protect the control knobs or switches on a stove in order to safe a homeowner from a tedious clean up job. It is easily mounted to a new stove or to a stove that has already been installed, can be quickly used to cover and protect the control knobs and can just as easily removed to be washed either in the sink or dishwasher.

SUMMARY OF THE INVENTION

The present invention consists of a substantially U-shaped guard that is attached to pivots that are mounted on the side of the stove. The pivots allow the guard to be moved quickly into or out of position and are detachably secured to the guard so the guard can be removed for cleaning.

It is an object of the present invention to provide a cover or guard for the control knobs on a cooking stove that can be quickly and easily mounted or removed from the stove.

It is an object of the present invention to provide a cover or guard for the control knobs on a cooking stove that is convenient and easy to use.

It is an object of the present invention to provide a cover or guard for the control knobs on a cooking stove that is inexpensive to manufacture.

These and other objects and advantages of the present invention will be fully apparent from the following description, when taken in connection with the annexed drawings.

DESCRIPTION OF THE PREFERRED EMBODIMENT

Figure 1:
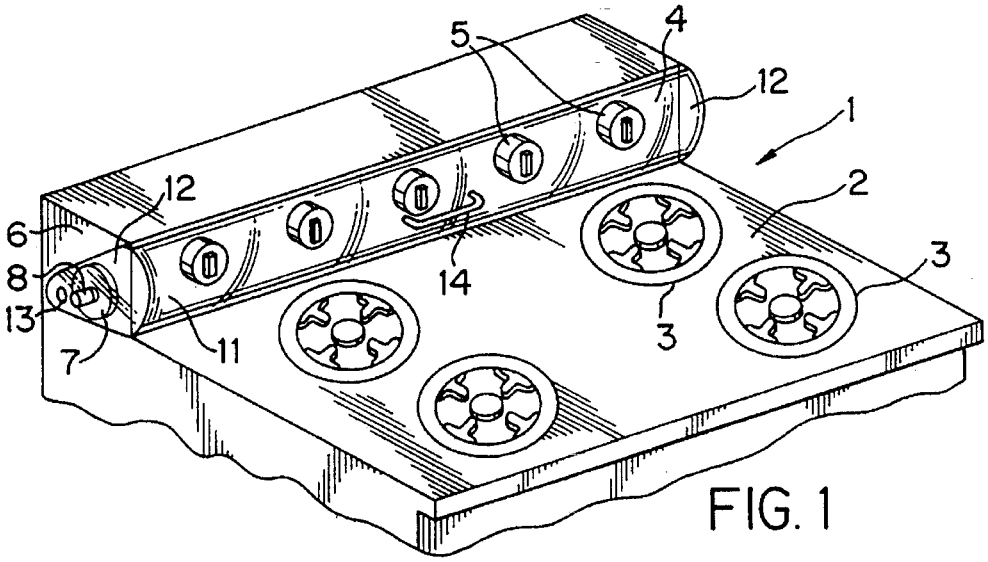
FIG. 1 is a perspective view of a conventional stove having a mounting disk and guard of the present invention attached.

Referring now to the drawings in greater detail, FIG. 1 shows a conventional stove 1, having a cooking top 2, burners 3, and a control panel 4, with control knobs 5. It should be noted that even though the stove illustrated is a gas stove, the present invention could be used with any stove powered with any conventional cooking medium. The stove I has an elevated cooking control panel 4 with sides 6 that raise the control panel above the surface 2 of the stove that has the cooking burners 3.

Figure 2:
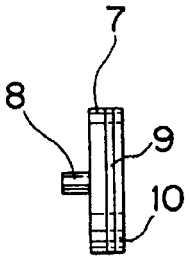
FIG. 2 is a side view of one of the mounting disks of the present invention.

Attached to the sides 6 on opposite sides of the stove are mounting disks, as shown in FIG. 2. Each disk has a body portion 7 that has a pivot pin 8 that can be unitary or integral with the body 7. On the side of the body opposite the pivot pin 8 is an adhesive layer 9 that is covered with a protective covering 10. When it is desired to attach the mounting disks to the side 6 of the stove 1, a user merely peels off the protective covering 10 and presses the mounting disk to the side of the stove. A mounting disk will be attached to opposite sides of the stove to attach the cover 11.

Figure 3:
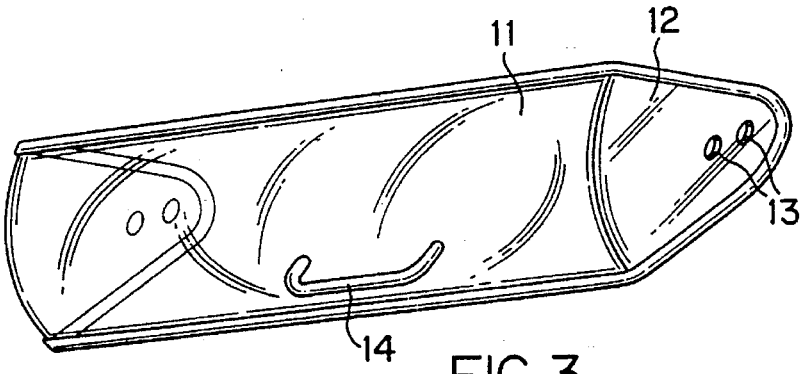
FIG. 3 is a perspective view of the guard of the present invention.

The cover 11 is shown in FIG. 3 and is made form any heat resistant material with a slight amount of resiliency such as, but not limited to, metal or plastic. Plastic is the preferred material since it can be made transparent and the control knobs will be visible therethrough, however, opaque plastic or metal could also be used.

The cover or guard 11 is preferably rounded in the front and has a pair of side pieces 12. Each of the side pieces could be made unitary or integral with the front portion of the cover. Each of the side pieces has a pair of apertures 13 therein. The size of the apertures 13 should be slightly larger than the outside diameter of the pins 8 on the mounting disks so the cover can pivot freely form the down position, shown in FIG. 1, to the up position (not shown) where the cover is above the control panel 4 of the stove 1. However, the size of the apertures should not be so large that the cover will have a tendency to fall into the down position of its own accord. There should be a slight friction fit between the pivot pins 8 and the apertures 13 in the cover so the cover will remain in whatever position it is placed.

Each of the side pieces 12 of the cover will have at least a pair of apertures 13 so the cover will be adaptable to different sizes of control panels 4. also, the cover should have a handle or small round knob 14 to assist in moving the cover from one position to another.

In order to install the cover on an existing stove it is only necessary to remove the protective coverings 10 from the mounting disks and attach them to opposite side of the stove. Once the disks are in place the cover 11 can be attached thereto by flexing the sides 12 apart until the apertures 13 will fit over the ends of the pivot pins 8. After that it is merely necessary to release the sides 12 and the resiliency of the material will pull the apertures onto the pins 8. The cover can be placed in the up position until the stove is in use.

Once the control knobs are placed in their proper heating position the cover can be rotated down to cover the knobs 5. In this position, the cover will protect the control panel from grease splatters or the like. If the knobs 5 have to be adjusted, the cover can be temporally raised, the knob adjusted to anew setting and the cover can then be lowered over the control panel once again.

If the cover becomes soiled with cooking splatters, it is a simple matter to remover the cover by pulling outward on the side pieces 12 until the apertures 13 can clear the ends of the pivot pins 8. The cover can then be washed in the sink or dishwasher and replaced on the stove.

Although the present invention has been describer as being attached to an already installed stove, the present invention could be incorporated in a stove as it is being manufactured. The mounting disks could be installed at the factory by the adhesive backs 9 or they could be made unitary with the sides 6 of the control panel 4.

Although the grease or splatter guard and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A protective cover for a stove having a raised control panel with control knobs on a front portion of said control panel, and said control panel having side panels, said cover comprising said cover having a front portion and at least two side portions, said side portions each having at least one aperture therein, means for detachably mounting said cover to said side panels of said control panel, said means comprising a mounting portion, means for permanently mounting said mounting portion to said side panels, pin means attached to said mounting portion for engaging said apertures in said side portions.

2. The protective cover for a stove as claimed in claim 1, wherein said means for permanently mounting said mounting portion to said side panels is an adhesive.

3. The protective cover for a stove as claimed in claim 1, wherein said cover has a small round knob attached thereto.

4. The protective cover for a stove as claimed in claim 1, wherein said said side portions each have at least two apertures therein.

5. The protective cover for a stove as claimed in claim 1, wherein said cover is made from transparent material.

* * * * *